United States Patent [19]

Hughes

[11] Patent Number: 4,587,603

[45] Date of Patent: May 6, 1986

[54] LANTERN HOLDER

[76] Inventor: Thomas M. Hughes, 310 Cardinal Dr., Taylors, S.C. 29687

[21] Appl. No.: 699,332

[22] Filed: Feb. 7, 1985

[51] Int. Cl.[4] ..... F21M 3/18

[52] U.S. Cl. ..... 362/427; 362/396; 362/418; 114/218

[58] Field of Search ..... 362/427, 396, 418; 114/364, 218; 248/225.2, 222.2

[56] References Cited

U.S. PATENT DOCUMENTS

| | | | |
|---|---|---|---|
| 1,916,322 | 7/1933 | Lindey | 362/427 |
| 2,327,273 | 8/1943 | Kehrer | 114/218 |
| 2,473,778 | 6/1949 | Benes | 114/364 |
| 2,618,285 | 11/1952 | Heisig | 362/427 |
| 2,833,504 | 5/1958 | Sacksteder | 362/427 |
| 4,280,172 | 7/1981 | Krogsrud | 362/427 |
| 4,328,536 | 5/1982 | Wallmark | 362/427 |
| 4,512,481 | 4/1985 | Thalerfeld | 248/222.2 |

FOREIGN PATENT DOCUMENTS

| | | | |
|---|---|---|---|
| 101268 | 9/1923 | Switzerland | 362/427 |
| 348802 | 5/1931 | United Kingdom | 362/427 |

*Primary Examiner*—E. Rollins Cross

*Attorney, Agent, or Firm*—Dority & Manning

[57] ABSTRACT

A lantern holder for supporting a lantern from a conventional cleat provided on the side of a boat. The lantern holder includes a pair of arms which are pivotally connected together adjacent the inner end of the lower arm and includes a U-shaped hook portion that can be readily inserted and removed from an opening provided in the conventional cleat. A substantially horizontally extending stabilizing projection is carried adjacent the U-shaped hook portion for restraining said attachment from lateral movement. A receiver is carried adjacent the outer end of the holder for receiving the holder of a conventional lantern.

4 Claims, 4 Drawing Figures

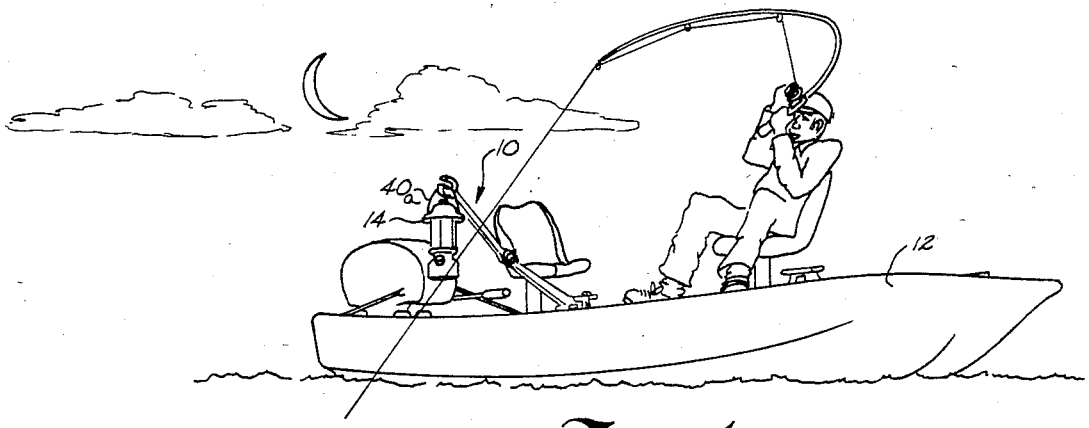
Fig. 1
Fig. 2
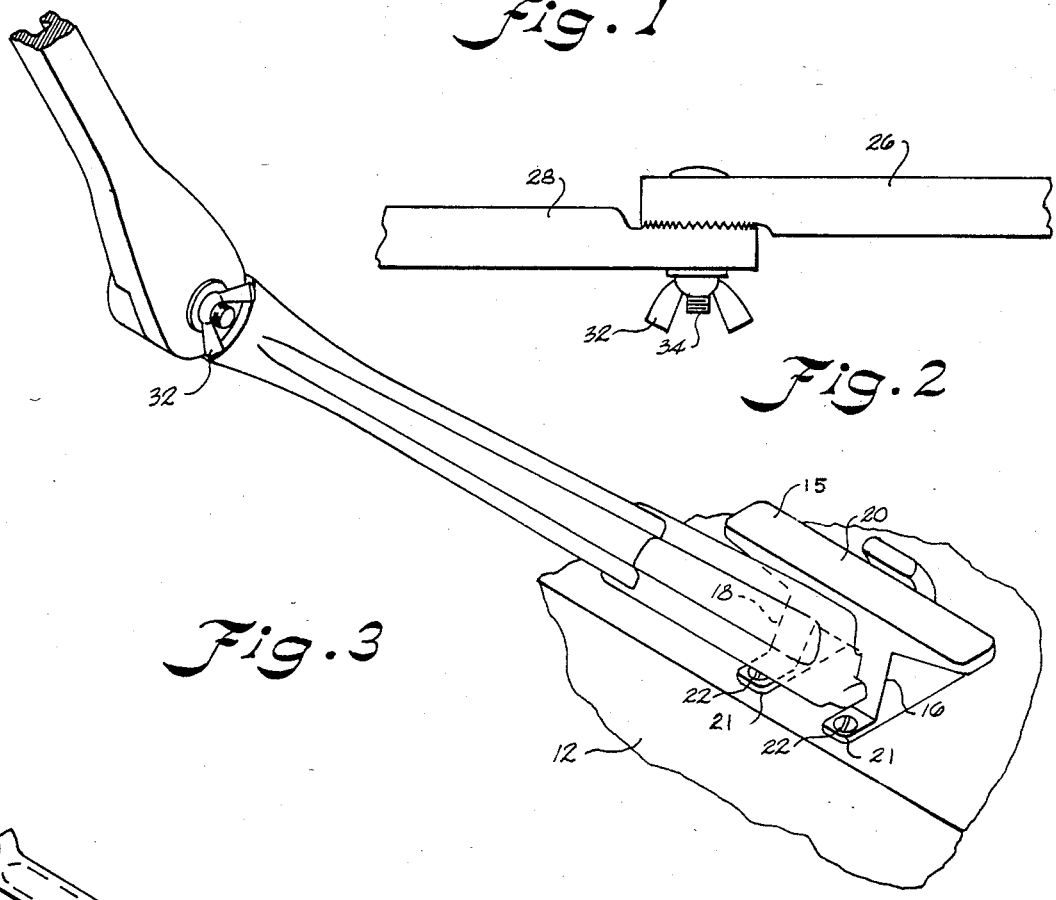
Fig. 3
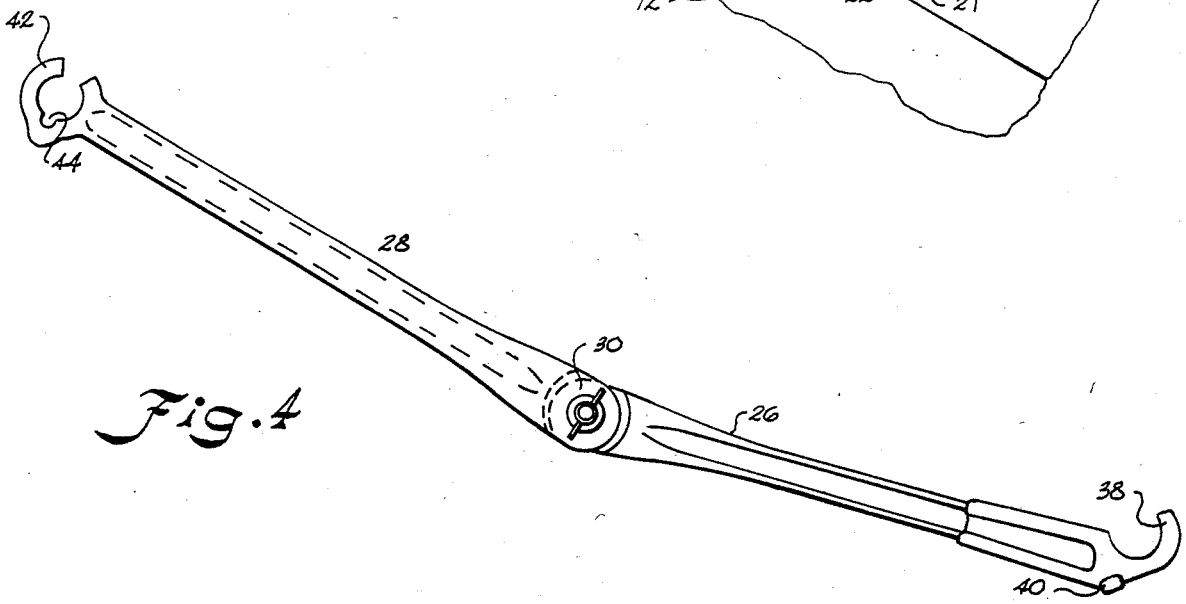
Fig. 4

LANTERN HOLDER

BACKGROUND OF THE INVENTION

When fishing at night from boats and the like, it is often desirable to use a light for attracting the fish. Lanterns that have mantels therein are the most common means of providing light in a boat. In order to maximize the effect of the light produced by the lantern, it is preferred that the lantern be held out beyond the side of the boat. Heretofore, special couplings have been utilized for securing the lantern holder to the side of the boat. One particular lantern holder utilizes a connecter that is attached to the side of the boat by screws and has an opening provided therein. The end of the lantern holder was placed in this elongated opening and a spring-loaded ball was used for making the connection therebetween. One problem with such a device is that there is a special attachment that is provided on the side of the boat and most fishermen want as few obstacles on their boat as possible. Oftentimes, the same boat that is used for fishing is used for water skiing, and it is desirable that the side of the boat be free of obstacles to provide ready access into and out of the boat.

SUMMARY OF THE INVENTION

The lantern holder constructed in accordance with the present invention is adapted to be readily attached to a conventional cleat provided on the boat. As a result, no additional brackets must be placed on the side of the boat. The lantern holder includes an elongated body which has an attachment means integral with one end thereof that can be readily inserted through an opening provided in a conventional cleat on the boat.

The attachment means includes a substantially vertically extending U-shaped hook portion for removable interengagement with the cleat. A substantially horizontally extending stabilizing projection carried integrally adjacent the U-shaped hook portion is provided for restraining the attachment means from lateral movement. In one particular embodiment, the lantern holder includes a first and second arm which are pivotally attached together with a receiver provided on the outer end thereof. The receiver and the pivotal arms are similar to that used in previous lantern holders.

Accordingly, it is an important object of the present invention to provide a simple and efficient lantern holder for use on boats and the like.

Another important object of the present invention is to provide a lantern holder which can be readily attached to the side of a boat through a cleat or the like.

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

BRIEF DESCRIPTION OF THE DRAWINGS

FIG. 1 is a perspective view illustrating a lantern holder constructed in accordance with the present invention mounted on the side of a boat;

FIG. 2 is an enlarged plan view illustrating the pivotal connection between the two arms forming the lantern holder;

FIG. 3 is an enlarged perspective view with parts broken away illustrating the manner in which the lantern holder is attached to the cleat on a boat;

FIG. 4 is an enlarged side elevational view of a lantern holder constructed in accordance with the present invention.

DESCRIPTION OF A PRFERRED EMBODIMENT

Referring to the drawings, there is illustrated in FIG. 1 a lantern holder generally designated by the reference character 10 mounted on the side of a boat 12 for holding a lantern 14 out over the side of the boat.

The lantern holder is adapted to be inserted through an opening provided in a conventional cleat 15 provided on the side of the boat. As seen in FIG. 3, the cleat includes a pair of vertically spaced support members 16 and 18 that have flanges 21 adjacent the lower ends thereof through which screws 22 pass for securing the cleat to the side of the boat. The upper end of the vertically spaced members 16 and 18 are integral with a horizontally extending tie-down 20. The outer edges of the tie-down 20 project out beyond the support members 16 and 18 so that rope can be wrapped therearound when securing the boat. This is the same cleat that is normally placed on the boat for use as a tie-down cleat.

The lantern holder includes a first and second arm 26 and 28 that are joined at a joint 30 by means of a wing nut 32 carried on the end of a threaded screw 34 that extends between the two arms. The inner surface of the two arms adjacent where they are connected together by the screw and wing nut is serrated so as to produce a positive fixed connection when the wing nut is tightened.

Adjacent the inner end of the lower arm 26 is an attachment means that can be readily inserted through the opening in the cleat 15. The attachment means includes a U-shaped portion 38 that is carried on the inner end of the lower arm 26. At the junction of the U-shaped portion and the lower end of the arm 26 is a laterally extending stabilizing projection 40. When the U-shaped portion 38 is inserted through the hole in the cleat as shown in FIG. 3, the inner end of the U-shaped member extends on the back side of the cleat and the stabilizing projection 40 projects out beyond the side of the vertical support member 16. The curvature of the U-shaped member 38 controls the angle that the lower arm 26 projects up from the cleat. The angle that the lantern is supported can be varied by loosening the wing nut 32 and adjusting the position of the second arm 28 relative to the first arm.

The handle **40*a* of the lantern is used for securing the lantern to the outer end of the lantern holder. Positioned on the outer end of the second arm 28 is a U-shaped attachment member 42 that has a slot 44 provided in the base thereof. The handle of the lantern is placed in the U-shaped attachment member 42 and rests in the slot 44 for securingly holding the lantern. As can be seen the lantern can be readily removed and the entire lantern holder removed from the cleat for storing. When it is desired to install the lantern on the cleat, it is only necessary to insert the U-shaped member 38 through the opening provided in the cleat. Normally the U-shaped portion 38 and the horizontally stabilizing projection 40** are coated with a suitable protective coating that is usually placed on tools to prevent scarring of the boat when the lantern holder is being used.

When the lantern is supported by its handle 40*a* on the outer end of the holder, such imparts a rotational force on the other end of the holder which includes the U-shaped member 38 and stabilizing projection 40. This causes the inner surface of the U-shaped member 38 to be drawn firmly against the bottom side of the tie-down 20 of the cleat.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What is claimed is:

1. A lantern holder for supporting a lantern from a cleat carried on a structure such as the gunwale of a boat, said cleat having an opening defined by a pair of spaced support members which are joined by a horizontal securing member, said holder comprising:

(a) an elongated support body including, (i) a first arm;

(ii) a second arm, and (iii) connection means releasably securing said first arm to said second arm;

(b) attachment means integral with said support body for removable interengagement with said cleat, said attachment means being carried adjacent an end of said first arm and including:

(i) a substantially vertically extending U-shaped hook portion for insertion through said opening in said cleat between said support members, and (c) receiver means integral with said support body carried adjacent an end of said second arm for removable receipt of a lantern, said receiver means being adapted to preclude inadvertent displacement of said lantern therefrom during normal use of said lantern holder.

2. A lantern holder as set forth in claim 1 wherein said attachment means includes:

a substantially horizontally extending stabilizing projection carried integrally adjacent to said U-shaped hook portion for restraining said attachment means from lateral movement through frictional contact of said stabilizing projection with said cleat.

3. A lantern holder as set forth in claim 1, wherein said attachment means includes:

a cushioned non-skid covering on said U-shaped hook portion and on said stabilizing projection, said cushioned non-skid covering both precluding marring of said support by said attachment means and increasing said frictional contact of said stabilizing projection with said support.

4. The lantern holder as set forth in claim 1, wherein said elongated support body includes connection means releasably securing said first arm to said second arm, said connection means allowing the distance between said attachment means and said receiver means to be selectively varied.

* * * * *